US007938655B2

(12) United States Patent
Komiyama et al.

(10) Patent No.: US 7,938,655 B2
(45) Date of Patent: May 10, 2011

(54) LEVER-TYPE CONNECTOR

(75) Inventors: Ryuichi Komiyama, Tokyo (JP); Kazushige Sakamaki, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 12/554,480

(22) Filed: Sep. 4, 2009

(65) Prior Publication Data

US 2009/0317993 A1 Dec. 24, 2009

Related U.S. Application Data

(63) Continuation of application No. PCT/JP2008/053839, filed on Mar. 4, 2008.

(30) Foreign Application Priority Data

Mar. 7, 2007 (JP) ..... 2007-056786

(51) Int. Cl.
*H01R 13/62* (2006.01)

(52) U.S. Cl. ..... 439/157

(58) Field of Classification Search ..... 439/157, 439/347, 489, 752, 595, 701
See application file for complete search history.

(56) References Cited

U.S. PATENT DOCUMENTS 5,938,458 A * 8/1999 Krehbiel et al. ..... 439/157
6,071,153 A * 6/2000 Fink et al. ..... 439/752
6,171,146 B1 * 1/2001 Fink et al. ..... 439/595
6,475,004 B2 * 11/2002 Shuey et al. ..... 439/157
6,666,697 B2 12/2003 Yamashita
6,890,194 B2 5/2005 Katsuma
2005/0106911 A1 * 5/2005 Sharples et al. ..... 439/157
2010/0178791 A1 * 7/2010 Komiyama et al. ..... 439/347

FOREIGN PATENT DOCUMENTS

JP 2006-331991 7/2006

OTHER PUBLICATIONS http://en.wikipedia.org/wiki/Newton's_laws_of motion.*
International Search Report issued in corresponding patent application PCT/JP200/053839 dated May 13, 2008.
IPRP and Written Opinion of the International Searching Authority dated Oct. 8, 2009, for PCT/JP2008/053839 (7 pages).

* cited by examiner

*Primary Examiner* — T C Patel
*Assistant Examiner* — Phuong T Nguyen
(74) *Attorney, Agent, or Firm* — Barley Snyder LLC

(57) ABSTRACT

There is provided a lever-type connector capable of preventing the dropping off from an inner housing from an outer housing to remain at a mating connector side, when the lever-type connector is separated from the mating connector. A lever-type connector is provided with an inner housing, an outer housing that is attached to the inner housing and that prevents the separation of a second seal; sliders that are received in slider receiving slots to move slidably and that have cam grooves into which cam pins arranged at the mating connector are inserted; and a lever that is provided at the outer housing to be movable and that slides the sliders. When the lever-type connector is separated from the mating connector, the sliders pull the inner housing in a direction away from the mating connector.

23 Claims, 13 Drawing Sheets

LEVER-TYPE CONNECTOR

CROSS-REFERENCE TO RELATED APPLICATIONS

This application is a continuation of PCT International Application No. PCT/JP2008/053839, filed Mar. 4, 2008, which claims priority under 35 U.S.C. §119 to Japanese Patent Application No. JP 2007-056786, filed Mar. 7, 2007.

FIELD OF INVENTION

The present invention relates to lever-type electrical connectors to reduce an operational force for mating.

BACKGROUND

When connectors having a number of terminals are mated, the mating resistance generated between mating contacts in both of the connectors becomes greater. Hence, it is generally difficult to mate the connectors by pushing the connectors by hand. For this reason, several kinds of what are called lever-type connectors, which utilize a toggle for reducing the operational force for mating, have been proposed.

As a conventional lever-type connector of such a kind, for example, the connectors shown in FIG. 11 and FIG. 12 are known. FIG. 11 is a cross-sectional view of a conventional lever-type connector. FIG. 12 is a cross-sectional view of a housing for use in the lever-type connector shown in FIG. 11.

A lever-type connector 101, shown in FIG. 11, is configured to be mated with a mating connector 150, and includes a housing 110, a pair of sliders 120, a lever 130, and a wire cover 140.

The housing 110 has, as shown in FIG. 12, a contact receiving portion 112 having multiple contact receiving cavities 111 that extend in the front-and-rear direction (in FIG. 12, the left side denotes front side and the right side denotes rear side). Each of the contact receiving cavities 111 receive a metal contact (not shown) connected to an electrical wire (not shown). In addition, the housing 110 is provided with a pair of upper and lower (in FIG. 12, the upper side denotes upper side and the lower side denotes lower side) slider receiving slots 113 that open at both of its left and right end surfaces (in FIG. 11, the left side denotes left side and the right side denotes right side). Furthermore, a pair of upper and lower lever receiving grooves 114 that open at the rear surface of the housing 110 are defined in the housing 110 and at the upper and lower outsides of the slider receiving slot 113. A sealing member 115 is provided at the outer circumference of the contact receiving portion 112. The sealing member 115 seals an area between the mating connector 150 to be mated with and the contact receiving portion 112 so as to have a function of preventing water from entering into the contact receiving cavities 111 from the mating part side.

Each of the sliders 120 are formed to have a plate shape, and are movably received in the slider receiving slot 113 of the housing 110. The inner surface of each slider 120 is provided with cam grooves 121 into which cam pins 152 arranged at a mating part 151 of the mating connector 150 are inserted, as shown in FIG. 11. Also, the outer surface of each slider 120 is provided with a pin portion 122 that is inserted into an interlocking groove 133, to be described later, arranged at the lever 130.

Additionally, the lever 130 is provided to extend from a pair of arms 132 (only one of the arms is shown in FIG. 11), each having a plate shape from both ends of an operation portion 131. Each arm 132 is provided with a pin opening 134. The lever 130 is supported for rotation with respect to the wire cover 140 by making the pin opening 134 fit with a supporting pin 141 arranged at the wire cover 140. Also, each arm 132 is provided with the interlocking groove 133 from its outer circumferential edge toward the pin opening 134.

Further, the wire cover 140 is attached at the rear side of the housing 110, so as to extract the electrical wire extracted from the housing 110 at one side of the left-and-right direction of the housing 110.

In order to mate the lever-type connector 101 and the mating connector 150, the lever 130 and the sliders 120 are firstly located at separated positions, so that the mating part 151 of the mating connector 150 is mated from the front side of the lever-type connector 101. Then, the cam pins 152 of the mating connector 150 enter the inlets of the cam grooves 121 arranged at the slider 120, as shown in FIG. 11, so both connectors 101 and 150 come to a temporary mating state. Subsequently, when the lever 130, at a separated position, is rotated toward the mating position, the interlocking groove 133 arranged at the lever 130 pushes the pin portion 122 of the slider 120 to the mating position. Thus, the slider 120 interlocks with the lever 130 to move from the separated position to the mating position. The operation of the cam grooves 121 and the cam pins 152 causes both of the connectors 101 and 150 to come closer to each other and come to the mating state.

Conversely, when the lever 130, at the mating position, is rotated toward the separated position, the slider 120 interlocks with the lever 130 to move from the mating position to the separated position. The operation of the cam grooves 121 and the cam pins 152 causes both of the connectors 101 and 150 to be separated from each other.

In this manner, the lever-type connector 101 is configured to employ the toggle including: the lever 130 that rotates; and the slider 120 that interlocks with the lever 130 and that has the cam grooves 121. Thus, the operational force for mating can be reduced considerably.

In the lever-type connector 101, as shown in FIG. 11 and FIG. 12, the mating connector 150 to be mated with and the contact receiving portion 112 are sealed with the sealing member 115 arranged at the outer circumference of the contact receiving portion 112, thereby preventing water from entering into the contact receiving cavities 111 from the mating side (front side) to be mated with the mating connector. In the lever-type connector 101, however, it is impossible to prevent water from entering into the contact receiving cavities 111 from the opposite side to the side to be mated with the mating connector.

Hence, conventionally, there is known connectors, as shown in FIG. 13 and FIG. 14, for example, as a connector that utilizes a cam-type toggle for preventing water from entering from the opposite side to the side to be mated with the mating connector. FIG. 13 is a plan view of a connector that utilizes the conventional cam-type toggle. FIG. 14 is a cross-sectional view of the connector of FIG. 13. A connector 201, which utilizes the cam-type toggle shown in FIG. 13 and FIG. 14, is configured to be mated with a mating connector 250, and is provided with a housing 210 and a pair of slide-type levers 220.

The housing 210 includes, as shown in FIG. 14, a contact receiving portion 212 having multiple contact receiving cavities 211 that extend in the front-and-rear direction (in FIG. 14, the left side denotes front side and the right side denotes rear side). Each of the contact receiving cavities 211 receive a metal contact 214 connected to an electrical wire (not shown). In addition, the housing 210 includes a pair of upper and lower (in FIG. 14, the upper side denotes upper side and the lower side denotes lower side) lever receiving grooves 213 that open at both of its left and right end surfaces (in FIG. 13, the left side denotes left side and the right side denotes right side). A first seal 215 is provided at the outer circumference of the contact receiving portion 212. The first seal 215 seals an area between a mating part 251 of the mating connector 250 to be mated with and the contact receiving portion 212 to have a function of preventing water from entering into the contact receiving cavities 211 from the mating part side. Additionally, a second sealing member receiving depression 216 is provided at the rear surface of the housing 210.

The second sealing member receiving depression 216 accommodates a second sealing member 240 having multiple electrical wire extracting openings 231 arranged at the positions corresponding to the contact receiving cavities 211, respectively. The second sealing member 240 is what is called a collective-type sealing member, such that the electrical wire extracting openings 231 are in tight contact with the outer circumferential surfaces of electrical wires connected to contacts 214, and in addition, the outer circumferential surface of the second sealing member 240 is in tight contact with the inner circumferential surface of the second sealing member receiving depression 216. This prevents water from entering into the contact receiving cavities 211 from the opposite side (rear side) to the side to be mated with the mating connector 150. A pushing member 230 for preventing the separation of the second sealing member 240 is attached at the rear side of the second sealing member 240. A latching arm 217 arranged at the housing 210 elastically latches with a notch 232 arranged at the pushing member 230, whereby the pushing member 230 is attached to the housing 210.

Each of the levers 220 are formed to have a plate shape, and are movably received in the lever receiving groove 213 of the housing 210. The inner surface of each lever 220 is provided with a cam groove 221 into which a cam pin 252 arranged at a mating part 251 of the mating connector 250 is inserted, as shown in FIG. 13.

In order to mate the connector 201 and the mating connector 250, the lever 220 is firstly located at a separated position, so that the mating part 251 of the mating connector 250 is mated from the front side of the lever-type connector 201. Then, the cam pin 252 of the mating connector 250 enters the inlet of the cam groove 221 arranged at the lever 220, as shown in FIG. 13, so both connectors 201 and 250 come to a temporary mating state. Subsequently, when the lever 220 at the separated position is pushed to the mating position, the operation of the cam groove 221 and the cam pin 252 causes both of the connectors 201 and 250 to come closer to each other and come to the mating state. Conversely, when the lever 220 at the mating position is returned to the separated position, the operation of the cam groove 221 and the cam pin 252 causes both of the connectors 201 and 250 to be separated from each other.

In the connector 201, the first seal 215 is capable of sealing between the contact receiving portion 212 and the mating connector 250 to be mated with, and in addition, the first seal 215 is capable of preventing water from entering into the contact receiving cavities 211 from the opposite side to the side to be mated with the mating connector. Also, the provision of the toggle including the lever 220, of a slide type, having the cam groove 221 achieves the reduction in the operational force for mating.

It should be noted, however, that the connector 201 is configured such that the lever 220 of a slide type is directly operated by hand. Accordingly, the reduction in the operational force for mating cannot be expected too much, as compared to the lever-type connector 101 having a toggle including the lever 130 that rotates and the slider 120 that interlocks with the lever 130 and that has the cam grooves 121.

Hence, conventionally, as schematically shown in FIG. 15, there has been developed a lever-type connector in which a family sealing member is provided for preventing water from entering into the contact receiving cavities from the opposite side to the side to be mated with the mating connector. In addition, such a lever-type connector has a toggle including: a lever that rotates; and a slider that interlocks with the lever and that has cam grooves. FIG. 15 schematically shows a cross-sectional view of another conventional lever-type connector.

A lever-type connector 301 shown in FIG. 15 is configured to be mated with a mating connector C, and is provided with an inner housing 310, a first seal 320, a second seal 330 (as a family seal), an outer housing 340, a pair of sliders 350, a lever 360, and a wire cover 370.

The inner housing 310 includes: a housing main body 312 having multiple contact receiving cavities 311 that extend in the front-and-rear direction (in FIG. 15, the left side denotes front side and the right side denotes rear side); and a hood 313 that protrudes rearward from the housing main body 312. Each of the contact receiving cavities 311 accommodates a metal contact (not shown) connected to an electrical wire (not shown).

The first seal 320 is arranged at the outer periphery of the housing main body 312, so as to seal between the housing main body 312 and the mating connector to be mated with, thereby preventing water entering into the contact receiving cavities 311.

In addition, the second seal 330 (as a family seal) is accommodated in the hood 313 of the inner housing 310 so as to be in tight contact with the inner circumferential surface of the hood 313. The second seal 330, as a family sealing member, prevents water from entering into the contact receiving cavities 311 from the rear side of the inner housing 310. An outer housing 340 is attached to the rear side of the second seal 330, as a family sealing member, so as to prevent the separation of the second seal 330, as a family sealing member. A latching arm (not shown) arranged at the inner housing 310 elastically latches a latching portion (not shown) arranged at the outer housing 340, whereby the outer housing 340 is attached to the inner housing 310.

The outer housing 340 is provided with: a main body 341 located at the rear side of the second seal 330, as a family sealing member; and a hood portion 342 that extends frontward from the outer circumferential end portion of the main body 341 so as to cover the inner housing 310. A pair of slider receiving slots 343 that extend in the left-and-right direction (in a direction orthogonal to the sheet surface of FIG. 15) are provided at both of upper and lower side portions of the hood portion 342 of the outer housing 340.

Each of the sliders 350 are formed to have a substantially plate shape, and are movably received in the slider receiving slot 343 of the outer housing 340. The inner surface of each slider 350 is provided with a cam groove 351 into which a cam pin (not shown) arranged at the mating connector is inserted. Also, each slider 350 is provided with a groove (not shown) into which a pin for slider movement arranged (not shown) at the lever 360.

Additionally, the lever 360 is rotatably supported with respect to the outer housing 340 so that the rotation of the lever 360 causes the sliders 350 to slide in the left-and-right direction.

Further, the wire cover 370 is attached to the rear side of the outer housing 340, so as to extract the electrical wire extracted from the outer housing 340 at one side in the left-and-right direction of the outer housing 340.

In order to mate the above lever-type connector 301 and the mating connector C, the lever 360 and the sliders 350 are firstly located at separated positions, so that the mating connector C is mated from the front side of the lever-type connector 301. Then, the cam pin of the mating connector C enters the inlet of the cam groove 351 arranged at the slider 350, so both of the lever-type connector 301 and the mating connector C come to a temporary mating state. Subsequently, when the lever 360 at the separated position is rotated toward the mating position, the pin for slider movement arranged at the lever 360 pushes the sliders 350. Thus, the slider 350 interlocks with the lever 360 to slide from the separated position to the mating position. The operation of the cam groove 351 and the cam pin causes both of the lever-type connector 301 and the mating connector C to come closer to each other and come to the mating state. Conversely, when the lever 360 at the mating position is rotated toward the separated position, the slider 350 interlocks with the lever 360 to slide from the mating position to the separated position. The operation of the cam groove 351 and the cam pin causes the lever-type connector 301 and the mating connector C to be separated from each other.

In this manner, the lever-type connector 301 is provided with the second seal 330, as a family sealing member, to prevent water from entering into the contact receiving cavities 311 from the rear side of the inner housing 310. Also, the lever-type connector 301 employs the toggle including: the lever 360 that rotates; and the slider 350 that interlocks with the lever 360 and that has a cam groove 351, thereby significantly reducing the operational force for mating. Additionally, the slider 350 is configured to be accommodated in the outer housing 340 for preventing the separation of the second seal 330, as a family sealing member, thereby downsizing the lever-type connector 301 and making the connector structure simple.

The lever-type connector 301 shown in FIG. 15, however, has following drawbacks.

That is, in order to mate the lever-type connector 301 and the mating connector C, when the lever 360 at the separated position is rotated toward the mating position, the slider 350 interlocks with the lever 360 and slides from the separated position to the mating position in the slider receiving slot 343 in the left-and-right direction. The operation of the cam groove 351 and cam pin causes the lever-type connector 301 and the mating connector C to come closer and come to a mating state. In this process, the front end surface of the slider 350 firstly pushes a front surface 343*b* of the slider receiving slot 343 arranged at the outer housing 340 in a direction of arrow X, that is, in the direction closer to the mating connector C. Next, the outer housing 340 pushes the rear end surface 313*a* of the inner housing 310 in the direction of arrow X.

Meanwhile, in order to separate the lever-type connector 301 and the mating connector C from each other, when the lever 360 at the mating position is rotated toward the separated position, the slider 350 interlocks with the lever 360 and slides from the mating position to the separated position in the slider receiving slot 343 in the left-and-right direction. The operation of the cam groove 351 and cam pin causes the lever-type connector 301 and the mating connector C to be separated from each other. In this process, the rear end surface of the slider 350 firstly pushes a rear surface 343*a* of the slider receiving slot 343 arranged at the outer housing 340 in a direction of arrow Y, that is, in the direction away from the mating connector C. Next, the outer housing 340 pushes the inner housing 310 in the direction of arrow Y via the latching portion, and the latching arm of the inner housing 310.

In this manner, when the lever-type connector 301 and the mating connector C are separated from each other, the outer housing 340 pulls the inner housing 310 in the direction of arrow Y via the latching portion, and the latching arm of the inner housing 310. In such a structure, connectors with lots of terminals are mated with each other and the mating resistance generated between both contacts becomes greater. Since the mating force of the inner housing 310 and the mating connector C is great, a great force is exerted onto the latching portion of the outer housing 340 and the latching arm of the inner housing 310. This damages the latching portion and the latching arm and causes malfunction in some cases. In a case where the latching portion does not function normally as described, the outer housing 340 cannot pull the inner housing 310 sufficiently and the inner housing 310 is separated from the outer housing 340, remaining at the mating connector C side.

Meanwhile, if the structure is configured such that the retaining force of the outer housing 340 and the inner housing 310 is enhanced by the latching portion of the outer housing 340 and the latching arm of the inner housing 310 so that the outer housing 340 can pull the inner housing 310 with certainty, there are limitations in the need for downsizing the lever-type connectors.

SUMMARY

The present invention has been made in view of the above circumstances, and has an object of providing a lever-type connector in which sliders are received in slider receiving slots of an outer housing, respectively, thereby preventing the separation of an inner housing from the outer housing and remaining at the mating connector side, when the lever-type connector and a mating connector are separated from each other.

The lever-type connector includes an inner housing receiving a contact, an outer housing attached to the inner housing and preventing separation of a family seal, a slider that is slidably received in a slider receiving slot provided at the outer housing and that has a cam groove into which a cam pin arranged at a mating connector is inserted, and a lever that is rotatably provided with respect to the outer housing and that makes the slider slide. As the lever rotates, the lever allows the lever-type connector to be mated with or separated from the mating connector, with the slider pulling the inner housing in a direction away from the mating connector, when the lever-type connector is separated from the mating connector.

BRIEF DESCRIPTION OF THE DRAWINGS

FIG. 2A illustrates a lever at a state before a mating connection is mated, and FIG. 2B illustrates the lever at a state after a mating connection is mated;

FIG. 3A is a front view thereof, and FIG. 3B is a cross-sectional view thereof taken along line 3B-3B of FIG. 3A;

FIG. 4A is a cross-sectional view thereof taken along line 4A-4A of FIG. 3A, and FIG. 4B is a cross-sectional view thereof taken along line 4B-4B of FIG. 3A;

FIG. 6A is a cross-sectional view illustrative of the lever and a slider, and FIG. 6B is a cross-sectional view thereof taken along line 6B-6B of FIG. 6A;

DETAILED DESCRIPTION OF THE EMBODIMENT(S)

Embodiments of the present invention will now be described with reference to the drawings.

Figure 1:
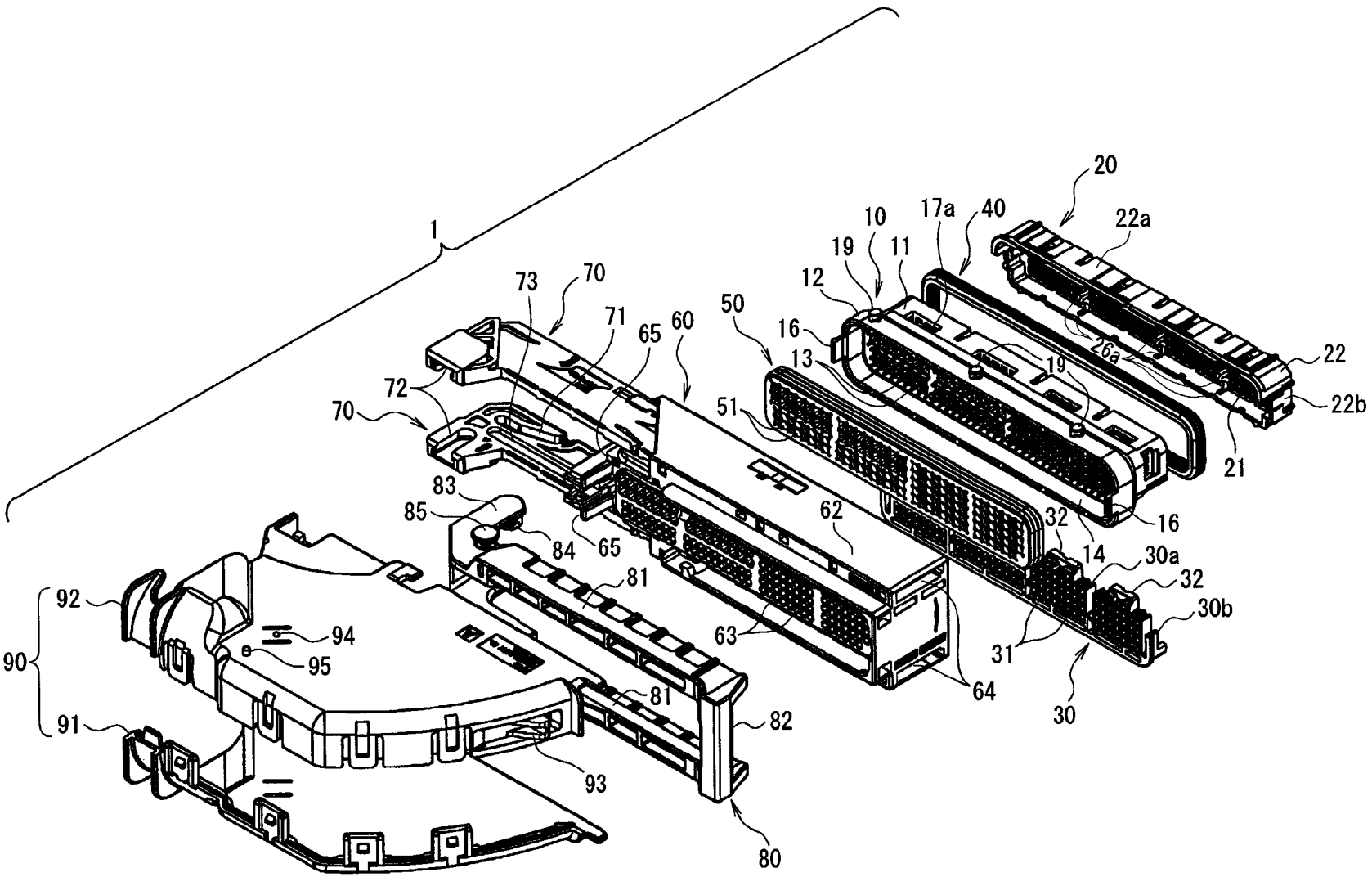
FIG. 1 is an exploded perspective view illustrative of a lever-type connector according to an aspect of the present invention.

A lever-type connector 1 illustrated in FIG. 1 includes an inner housing 10, a front cover 20, a retainer 30, a first seal 40, a second seal 50 (as a family sealing member), an outer housing 60, a pair of sliders 70, a lever 80, and a wire cover 90.

Herein, the inner housing 10 is integrally formed by molding an insulating resin. As illustrated in FIG. 1 and FIGS. 3A to FIG. 5, the inner housing 10 is provided with a housing main body 11 that has a substantially rectangular parallelepiped shape and that extends in the widthwise direction (left-and-right direction in FIG. 3A), in the up-and-down direction (up-and-down direction in FIG. 3A), and in the front-and-rear direction (up-and-down direction in FIG. 3B), and a hood portion 12 that extends rearward from the housing main body 11. The housing main body 11 is provided with multiple contact receiving cavities 13 that extend therethrough in the front-and-rear direction. The inner space of the hood portion 12 defines a second seal receiving space 14. Each of the contact receiving cavities 13 is provided with a housing lance 15 that principally latches a contact, not illustrated.

Figure 4A:
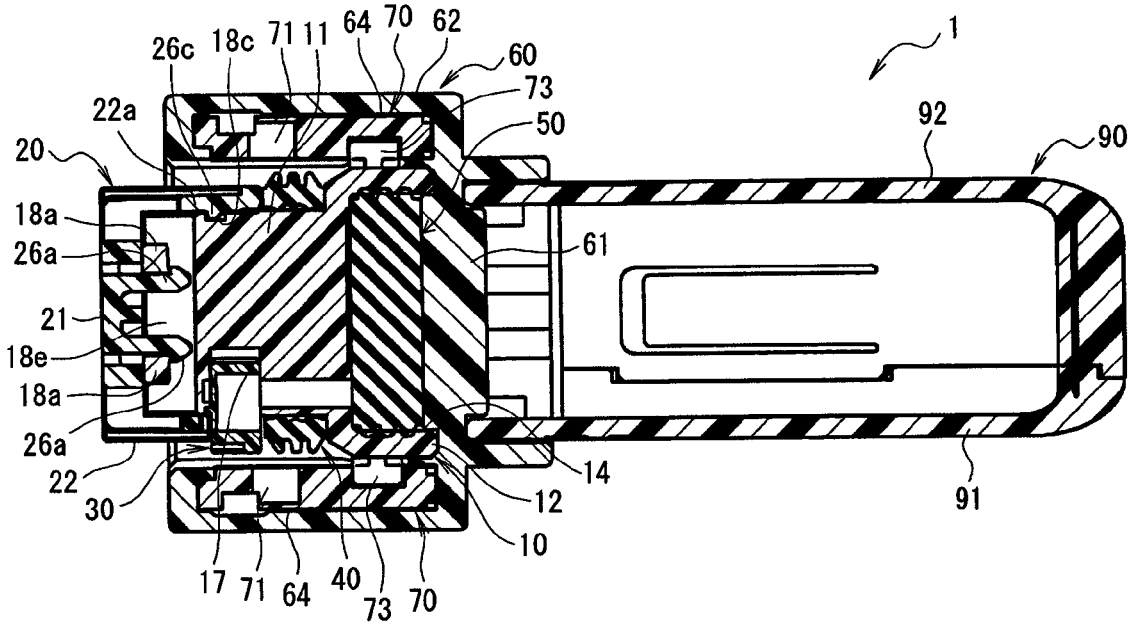
FIG. 4A and FIG. 4B illustrate the lever-type connector of FIG. 1.
Figure 4B:
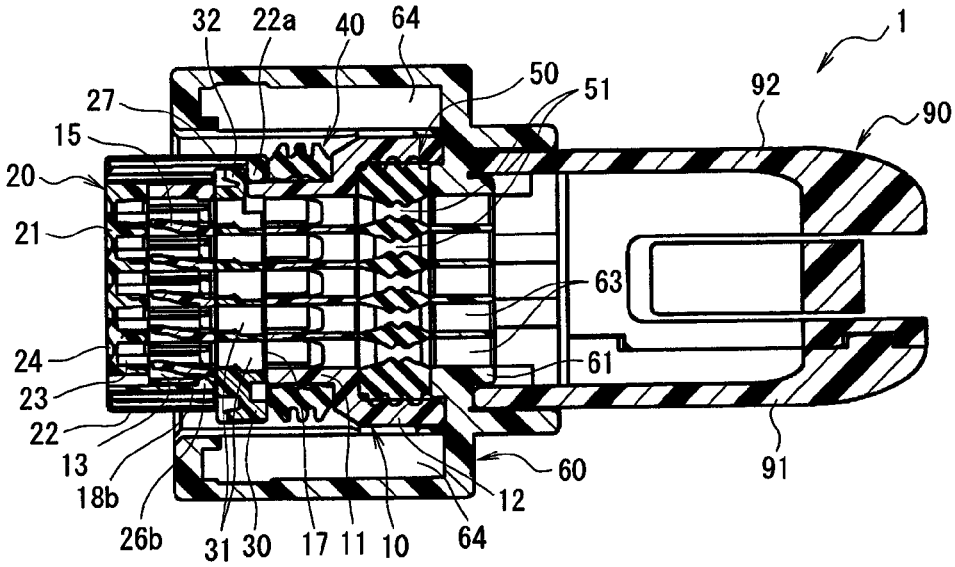

The housing main body 11 is provided with a retainer receiving depression 17 that opens downward and extends upward, as illustrated in FIG. 4B. The upper surface of the retainer receiving depression 17 is provided with multiple housing openings 17*a*, as illustrated in FIG. 1 and FIG. 4B. Front cover retaining protrusions 32, to be described later, of the retainer 30 are allowed to penetrate through the openings 17*a*, respectively, to project at the upper side of the housing main body 11.

In addition, a pair of housing latch arms 16, which latch the outer housing 60 with the inner housing 10, are formed to protrude rearward at both end portions in the widthwise direction of the hood portion 12 of the inner housing 10, as illustrated in FIG. 1. Meanwhile, the front surface of the housing main body 11 of the inner housing 10 is provided with multiple grooves 18*e* that penetrate therethrough in the up-and-down direction, as illustrated in FIG. 4A. The front end portion of each of the grooves 18*e* are provided with a pair of housing latching portions 18*a* that are latched with elastic latch arms, spaced away from each other at given intervals in the up-and-down direction, arranged at the front cover 20, respectively, as illustrated in FIG. 4A. Each of the housing latching portions 18*a* are provided to come across the groove 18*e* in the widthwise direction. Also, the bottom surface of the housing main body 11, that is, the front surface of the retainer receiving depression 17 in the housing main body 11, is provided with multiple cutouts 18*b* that are latched with second elastic latch arms 26*b* arranged at the front cover 20, as illustrated in FIG. 4B.

Figure 3A:
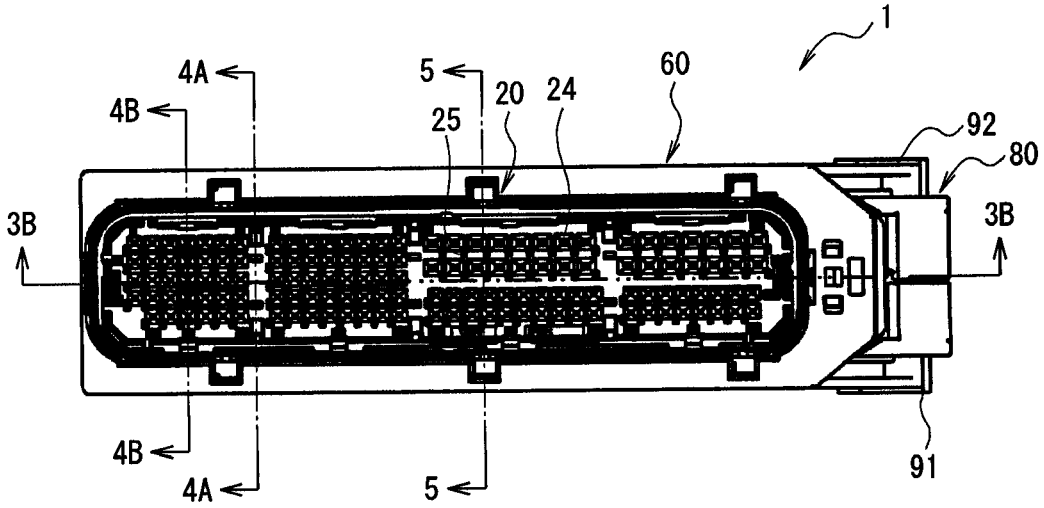
FIG. 3A and FIG. 3B illustrate the lever-type connector of FIG. 1.
Figure 3B:
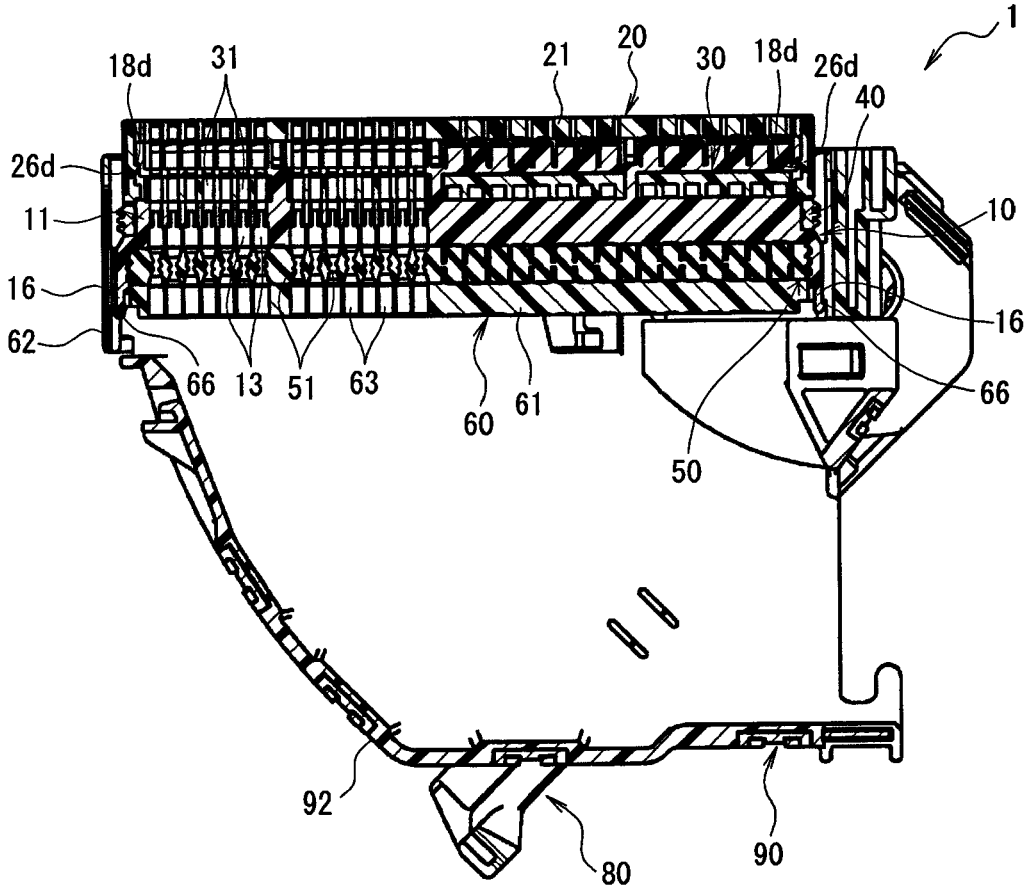

Further, the top surface of the housing main body 11 is provided with a depression 18*c* into which a front cover projection 26*c* arranged at the front cover 20, enters, as illustrated in FIG. 4A. Moreover, both of side walls in the widthwise direction of the housing main body 11 are provided with latching depressions 18*d* to be locked with elastic side locks 26*d* arranged at the front cover 20, respectively, as illustrated in FIG. 3B.

Also, multiple projections 19 are formed to protrude at given intervals in the widthwise direction at both of upper and lower surfaces of the hood portion 12 of the inner housing 10.

Additionally, the front cover 20 is attached to the front side of the inner housing 10, and is provided with a main body 21 that extends in the widthwise direction so as to cover the front surface of the housing main body 11, as illustrated in FIG. 1. The front cover 20 is formed by molding an insulating resin. A hood 22 that covers the upper surface and both of side surfaces in the widthwise direction is provided at the rear surface of the main body 21 so as to extend rearward.

Figure 5:
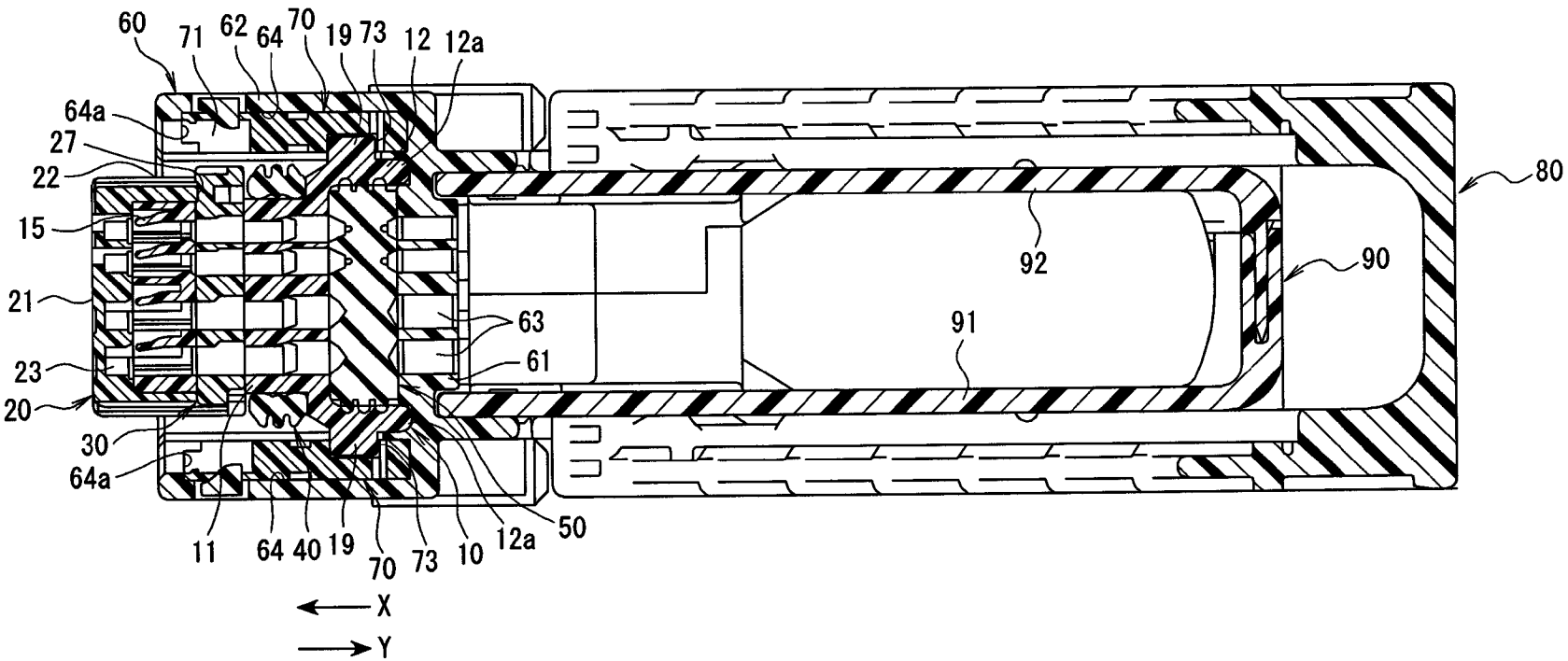
FIG. 5 is a cross-sectional view taken along line 5-5 of FIG. 3A, and in FIG. 5, the state where a retainer at a permanent locking position is illustrated.
Figure 6A:
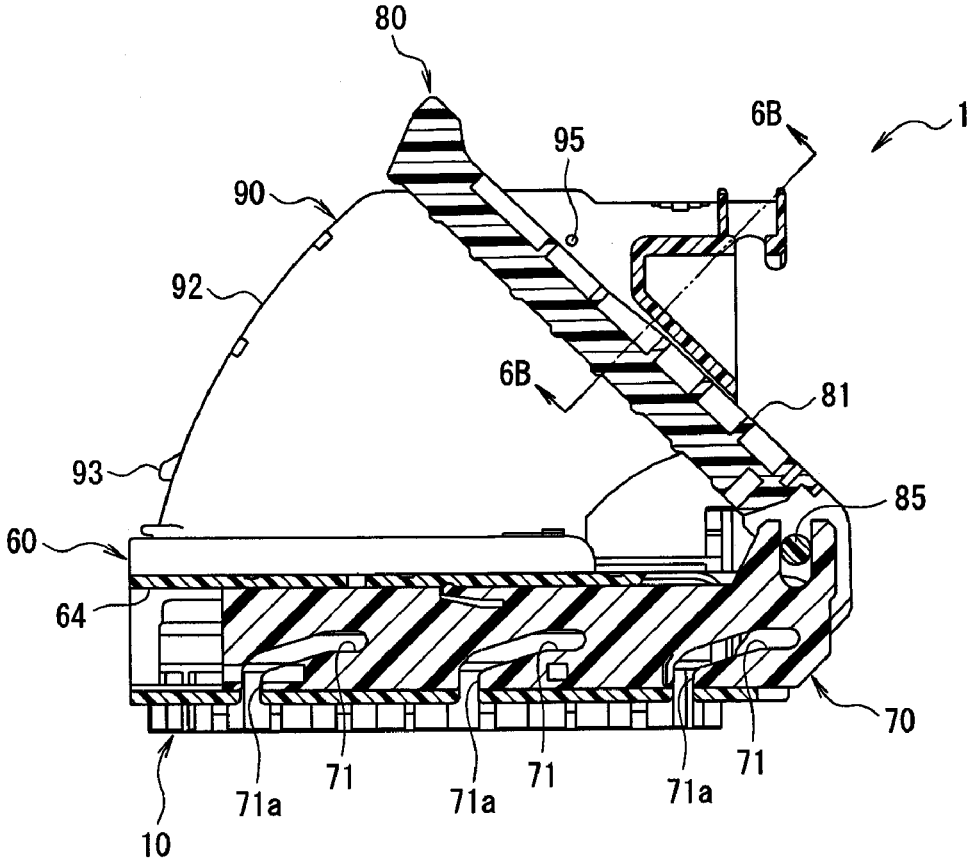
FIG. 6A and FIG. 6B illustrate the lever-type connector with a lever located at a separated position.
Figure 6B:
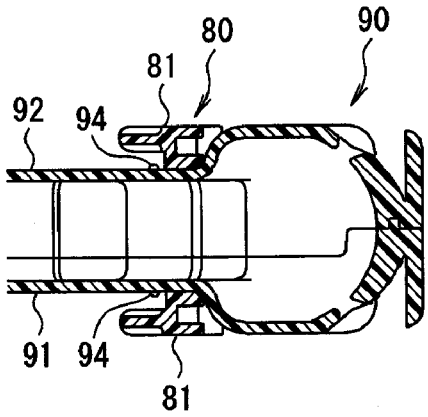

Herein, multiple contact receiving chambers 23 are defined at the rear surface of the main body 21 of the front cover 20, at positions corresponding to the contact receiving cavities 13 provided at the housing main body 11, as illustrated in FIG. 4B and FIG. 5. In addition, multiple mating terminal insertion openings 24 communicated with the contact receiving chambers 23 at the front surface of the main body 21, at positions corresponding to the contact receiving cavities 13 provided at the housing main body 11. Further, tool openings 25 into which a tool (not illustrated) for removing the contacts (not illustrated) by functioning the housing lance 15, are arranged at the front surface of the main body 21 and below the mating terminal insertion openings 24.

Figure 7A:
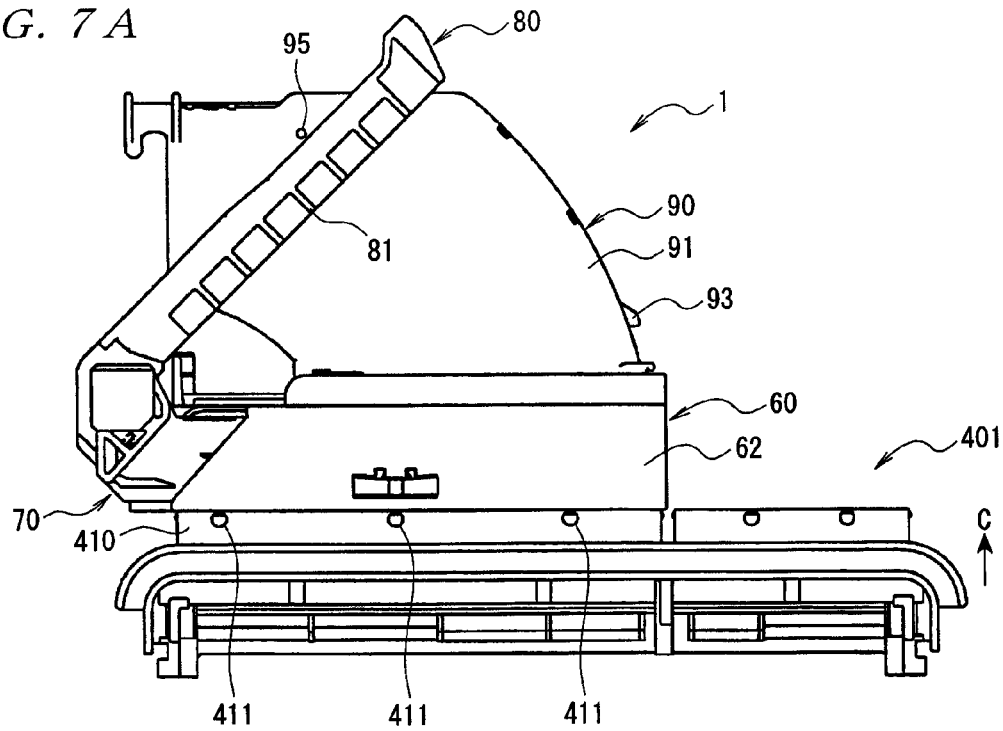
FIG. 7A to FIG. 7C are explanatory views illustrative of a state before the lever-type connector and the mating connector are mated.
Figure 7B:
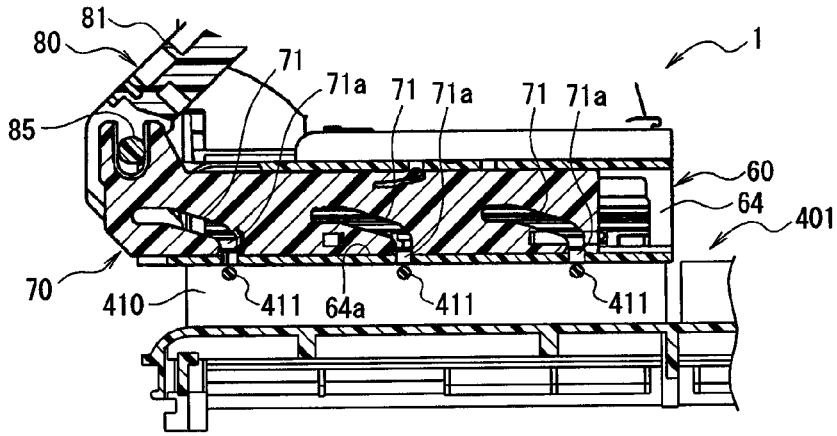
Figure 7C:
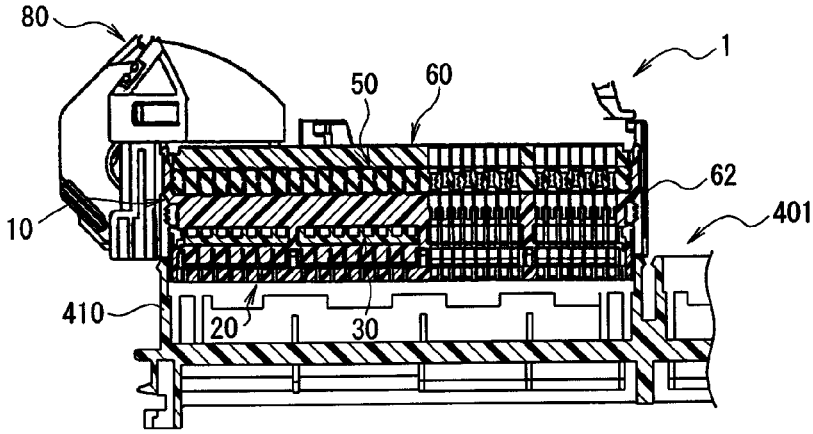

The design of the front cover 20 avoids the drawbacks that a mating terminal (not illustrated) arranged at a mating connector 401 is brought into contact with a contact and the like, when the lever-type connector 1 is mated with the mating connector 401 (see FIG. 7A to FIG. 7C). That is to say, it is possible to protect the contacts accommodated in the inner housing 10.

Also, multiple pairs of front cover latch arms 26*a* are formed at the main body 21 of the front cover 20 so as to protrude rearward at given intervals in the widthwise direction, as illustrated in FIG. 1. Each of the front cover elastic latch arms 26*a* are pushed between the pair of the housing latching portions 18*a* arranged at the inner housing 10 so as to be latched with the housing latching portions 18*a*, as illustrated in FIG. 4A.

Each pair of front cover elastic latch arms 26*a* are arranged, as illustrated in FIG. 4A, to be spaced apart from each other at given intervals in the up-and-down direction of the main body 21. Also, multiple second elastic latch arms 26*b* to be respectively latched with the cutouts 18*b* arranged at the inner housing 10 are provided below the main body 21 of the front cover 20, as illustrated in FIG. 4B. Further, an upper wall 22*a* of the hood 22 in the front cover 20 is provided with the front cover projection 26*c* that enters into a depression 28*c*, which is arranged with the inner housing 10, as illustrated in FIG. 4A. Additionally, both of the side walls 22*b* of the hood 22 in the front cover 20 are provided with a pair of the elastic side locks 26*d* to be locked with the latching depressions 18*d* of the inner housing 10.

Further, the upper wall 22*a* of the hood 22 in the front cover 20 is provided with multiple front cover openings 27, through which the front cover retaining protrusions 32, to be described later, of the retainer 30 are inserted, as illustrated in FIG. 4B. Each of the multiple front cover openings 27 regulate the movement in the front-and-rear direction of the front cover 20 with each of the front cover retaining protrusions 32 of the retainer 30 inserted into each of the front cover openings 27, when the retainer 30 is attached to the inner housing 10.

Next, the retainer 30 is attached in the retainer receiving depression 17 from the lower side of the inner housing 10. As illustrated in FIG. 1, FIG. 4A, and FIG. 4B, the retainer 30 is formed to have a substantially plate shape that extends in the widthwise direction. The retainer 30 is temporarily retained by the inner housing 10 at a temporary locking position, as shown in FIG. 4A and FIG. 4B, is further pushed into the inner housing 10, and is secured by the inner housing 10 at a proper locking position illustrated in FIG. 5. The proper locking state of the retainer 30 denotes that the retainer 30 is pushed completely. The retainer 30 has multiple contact insertion openings 31 arranged to correspond to the contact receiving cavities 13, respectively, arranged at the housing main body 11, as illustrated in FIG. 4B. Then, multiple front cover retaining protrusions 32 are formed to protrude upward at an upper end surface 30*a* of the retainer 30.

When the retainer 30 is located at the temporary locking position, contacts, not illustrated, are inserted into the contact receiving cavities 13, respectively, so that the contacts are primarily locked by the housing lance 15. Subsequently, when the retainer 30 is moved to the proper locking position, the contacts are secondarily locked by the retainer 30.

The first seal 40 is formed to have a ring shape to be in tight contact with the outside of the housing main body 11 of the inner housing 10, as illustrated in FIG. 1, FIG. 4A, and FIG. 4B. The first seal 40 seals an area between the housing main body 11 and the mating connector 401, and has a function of preventing water entering into the inner housing 10 from the mating part, when the lever-type connector 1 is mated with the mating connector 401.

The second seal 50 or family sealing member is formed to have a substantially plate shape and is received in a second seal receiving space 14 of the hood portion 12 in the inner housing 10 so as to be in tight contact with the inner circumferential surface of the hood portion 12, as illustrated in FIG. 1 and FIG. 4A. The second seal 50 is provided with multiple electrical wire insertion openings 51 at positions corresponding to the contact receiving cavities 13, respectively, as illustrated in FIG. 1 and FIG. 4B. The electrical wires (not illustrated) connected to the contacts accommodated in the contact receiving cavities 13 are extracted rearward through the electrical wire insertion openings 51.

Furthermore, the outer housing 60 is attached to the rear side of the inner housing 10 to prevent the separation of the second seal 50. The outer housing 60 is formed to be a single member by molding an insulating resin. The outer housing 60 is formed to have a substantially rectangular parallelepiped shape that extends in the widthwise direction, in the front-and-rear direction, and in the up-and-down direction. The outer housing 60 is provided with: a main body 61 that extends in the widthwise direction and that is located at the rear side of the second seal 50; and a hood portion 62 that extends frontward from an outer circumferential end portion of the main body 61 and that covers the inner housing 10, as illustrated in FIG. 4A. The main body 61 of the outer housing 60 is provided with multiple electrical wire extracting openings 63 at positions corresponding to the contact receiving cavities 13, respectively, as illustrated in FIG. 4B. A pair of slider receiving slots 64 that extend in the widthwise direction are defined at both of upper and lower portions of the hood portion 62 of the outer housing 60. Moreover, a step portion 66, with which the latch arm 16 arranged at the inner housing 10 is latched, is provided at the rear surface of the outer housing 60, as illustrated in FIG. 3B. Also, a pivot receiving portion 65 into which a pivot 84, to be described later, of the lever 80 is fit is provided at one end portion in the widthwise direction of the hood portion 62 of the outer housing 60, as illustrated in FIG. 1.

Each slider 70 is formed to have a substantially plate shape by molding an insulating resin, and is movably accommodated in the slider receiving slot 64 of the outer housing 60. The inner surface of each of the sliders 70 is provided with cam grooves 71 into which cam pins 411 (see FIG. 7A to FIG. 7C) arranged at the mating connector 401 enter, respectively. In addition, one end portion of the inner surface of each of the sliders 70 is provided with a slider depression 72 into which a projection for slider movement 85, to be described later, arranged at the lever 80 is inserted. Further, the inner surface of each slider 70 is provided with a projection insertion groove 73 into which the projections 19 arranged at the inner housing 10 are respectively fit, as illustrated in FIG. 1 and FIG. 4A to FIG. 5. The projection insertion groove 73 linearly extends from an end edge opposite to the end portion having the slider depression 72 in the slider 70, and the width of the projection insertion groove 73 is made slightly wider than the diameter of the projection 19. The projection insertion groove 73 pulls the inner housing 10 in the direction of arrow Y via the projections 19 as illustrated in FIG. 5, when the lever-type connector 1 is separated from the mating connector 401, as will be described later in more detail.

The lever 80 is provided with: a pair of arms 81; and a connector 82 that connects one ends of the arms 81, as illustrated in FIG. 1. The other end of each of the arms 81 is provided with an extension 83 that extends at right angle with respect to the arm 81, and the inner surface of an end of each extension 83 is provided with the pivot 84 to be formed to protrude. Meanwhile, the outer surface of the other end portion of each arm 81 is provided with the projection for slider movement 85 that is fit into the slider depression 72 of each slider 70.

Figure 2A:
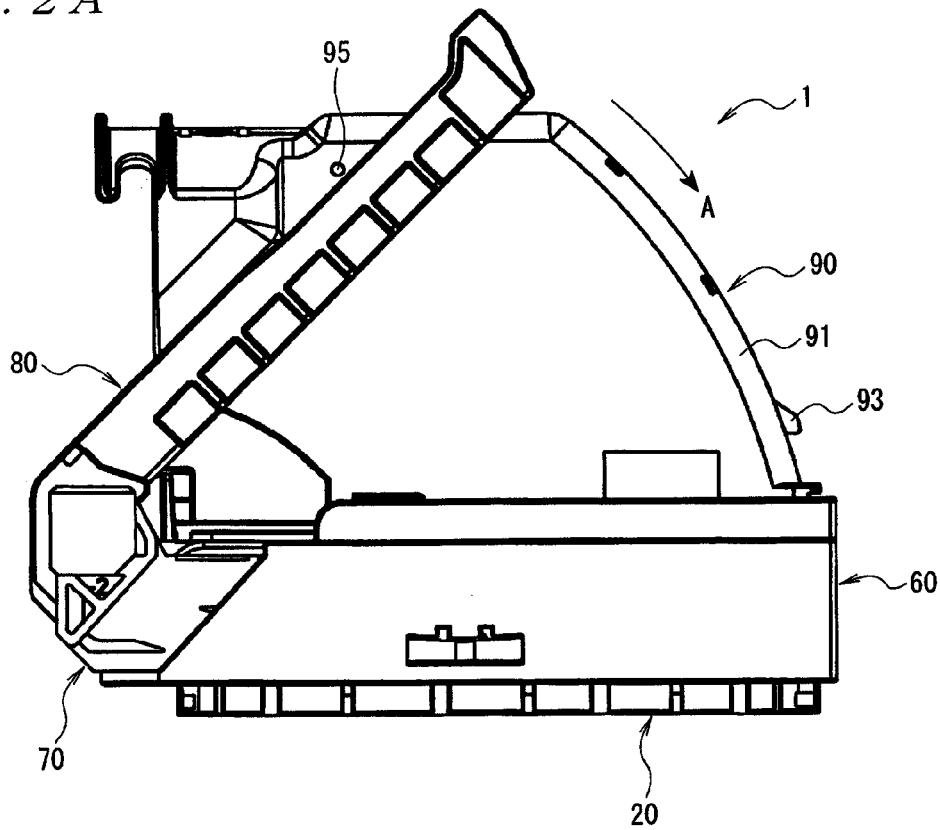
FIG. 2A and FIG. 2B illustrate the lever-type connector of FIG. 1.
Figure 2B:
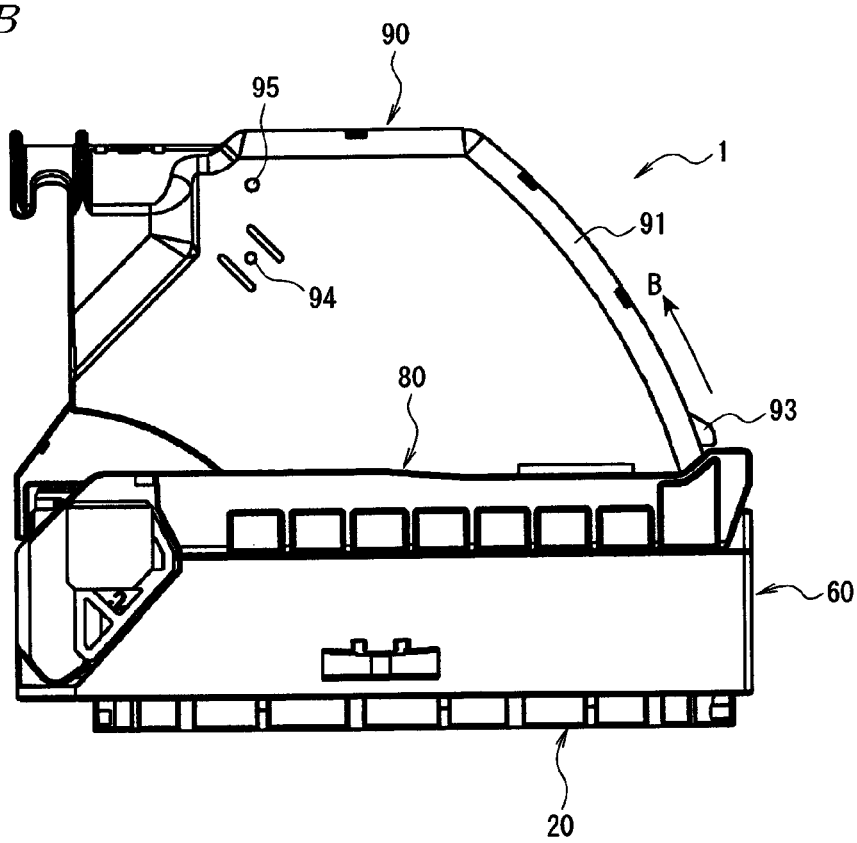

The pivot 84 of the lever 80 is fit into the pivot receiving portion 65 arranged at one end in the widthwise direction of the outer housing 60, so as to rotate in both of the direction of arrow A illustrated in FIG. 2A and the direction of arrow B illustrated in FIG. 2B, with respect to the outer housing 60. When the lever 80 is rotated from the separated position illustrated in FIG. 2A to the mating position illustrated in FIG. 2B in the direction of arrow A, the projection for slider movement 85 arranged at the lever 80 pushes the slider 70. This causes the slider 70 to interlock with the lever 80 and slide in the direction of being accommodated in the slider receiving slot 64. The operation of the cam grooves 71 and the cam pins 411 causes the lever-type connector 1 and the mating connector 401 to come closer to each other and come to the mating state. Conversely, when the lever 80 is rotated from the mating position to the separated position in the direction of arrow B, the slider 70 interlocks with the lever 80 to slide in the direction of getting out of the slider receiving slot 64. The operation of the cam grooves 71 and the cam pins 411 causes the lever-type connector 1 and the mating connector 401 to be separated from each other. Such mating and separating operations will be described later in more detail.

Moreover, the wire cover 90 includes: a lower side cover 91; and an upper side cover 92 that is attached at the lower side cover 91. The wire cover 90 is attached at the rear side of the outer housing 60 so as to extract multiple electrical wires extracted from the electrical wire extracting openings 63 of the outer housing 60 to one side in the widthwise direction of the outer housing 60. Each of the upper side cover 91 and the lower side cover 92 is provided with a first regulating projection 94 that regulates the rotation in the direction of arrow A from the separated position of the lever 80, as illustrated in FIG. 1, FIG. 2A, FIG. 2B, FIG. 6A, and FIG. 6B. Also, each of the upper side cover 91 and the lower side cover 92 is provided with a second regulating projection 95 that regulates the rotation in the direction opposite to the direction of arrow A from the separated position of the lever 80, as illustrated in FIG. 1, FIG. 2A, FIG. 2B, FIG. 6A, and FIG. 6B. Furthermore, the lower side cover 92 is provided with a lock 93 that prevents the rotation in the direction of arrow B, when the lever 80 rotates in the direction of arrow A and is located at the mating position.

Next, an assembling method of the lever-type connector 1 will be described.

In order to assemble the lever-type connector 1, the first seal 40 is firstly attached to the outside of the housing main body 11 in the inner housing 10.

Next, the front cover 20 is attached to the front side of the inner housing 10. In this situation, as illustrated in FIG. 4A, each pair of the front cover elastic latch arms 26*a* are pushed between each pair of the housing latching portions 18*a* arranged at the inner housing 10 and are latched by the housing latching portions 18*a*. As illustrated in FIG. 4A, the front cover projection 26*c* arranged at the front cover 20 enters into the depression 18*c* arranged at the inner housing 10. Also, as illustrated in FIG. 4B, the second elastic latch arms 26*b* arranged at the front cover 20 are latched by the cutouts 18*b* arranged at the inner housing 10. Further, as illustrated in FIG. 3B, the elastic side locks 26*d*, arranged at the front cover 20, are latched by the latching depressions 18*d* of the inner housing 10.

Subsequently, the retainer 30 is inserted into the retainer receiving depression 17 from the lower side of the inner housing 10, and is locked at the temporary position, as illustrated in FIG. 4A and FIG. 4B. When the retainer 30 is located at the temporary locking position, each of the contact insertion openings 31 is located at the position conforming to the corresponding contact receiving cavity 13 of the inner housing 10. Also, in this situation, the front cover retaining protrusion 32 of the retainer 30 protrudes through the opening 17*a* of the inner housing 10 and penetrates through the front cover opening 27 of the front cover 20, as illustrated in FIG. 4B, thereby regulating the movement in the front-and-rear direction of the front cover 20.

Next, the second seal 50 is accommodated in the second seal receiving space 14 of the hood portion 12 from the rear side of the inner housing 10. This causes the outer circumferential surface of the second seal 50 to be tight with the inner circumferential surface of the hood portion 12.

Then, the outer housing 60 is attached from the rear side of the inner housing 10 to which the first seal 40, the front cover 20, the retainer 30, and the second seal 50 are installed. In this process, a latch arm 16 arranged at the inner housing 10 is latched with the step portion 66 of the outer housing 60. This prevents the separation of the second seal 50 from the second seal receiving space 14.

After that, the pair of the sliders 70 are inserted into the slider receiving slots 64 of the outer housing 60 from the end edge of the side opposite to the slider depression 72 arranged at one end thereof. In this situation, as illustrated in FIG. 5, the projections 19 arranged at the inner housing 10 are fit into the projection insertion groove 73 of the slider 70.

Next, the pivot 84 of the lever 80 is fit into the pivot receiving portion 65 arranged at one end portion in the widthwise direction of the outer housing 60, and the projection for slider movement 85 of the lever 80 is fit into the slider depression 72 of each slider 70. In this manner, the lever 80 is rotatable in both of the direction of arrow A illustrated in FIG. 2A and the direction of arrow B illustrated in FIG. 2B. Also, the sliders 70 are capable of moving slidably in the slider receiving slot 64 in conjunction with the rotational movement of the lever 80.

Subsequently, multiple contacts connected to the electrical wires are received in the contact receiving cavities 13 of the inner housing 10 via the electrical wire extracting openings 63 and the electrical wire insertion openings 51 of the second seal 50 from the rear side of the outer housing 60, respectively. In this process, the housing lance 15 arranged at the inner housing 10 primarily locks each contact.

Subsequently, the retainer 30 at the temporary locking position is pushed to the proper locking position. Then, the contacts are locked by the retainer 30 secondarily. In this situation, the front cover retaining protrusions 32 arranged at the retainer pass through the front cover openings 27 of the front cover 20 and regulates the movement of the front cover 20 in the front-and-rear direction.

Lastly, the wire cover 90 is attached at the rear side of the outer housing 60, and then multiple electrical wires extracted from the electrical wire extracting openings 63 of the outer housing 60 to be further extracted to one side in the longitudinal direction of the outer housing 60.

The assembling of the lever-type connector 1 is completed by the above processing.

The mating and separating operations of the lever-type connector 1 and the mating connector 401 will now be described with reference to FIG. 5, FIG. 7A to FIG. 10C.

Figure 8A:
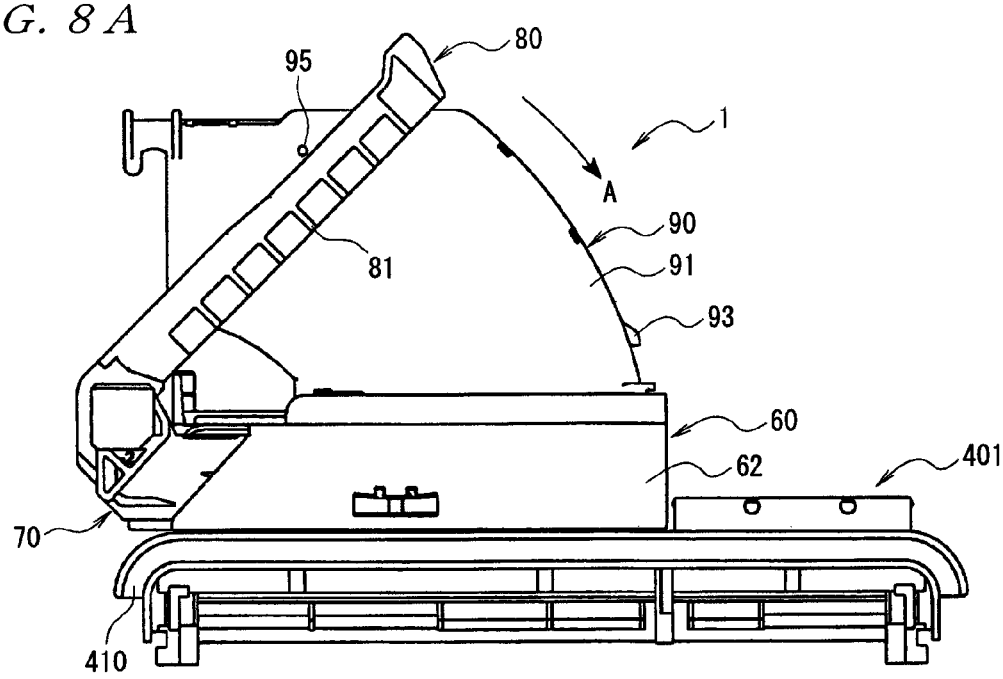
FIG. 8A to FIG. 8C are explanatory views illustrative of a mating state where the lever-type connector and the mating connector are mated.
Figure 8B:
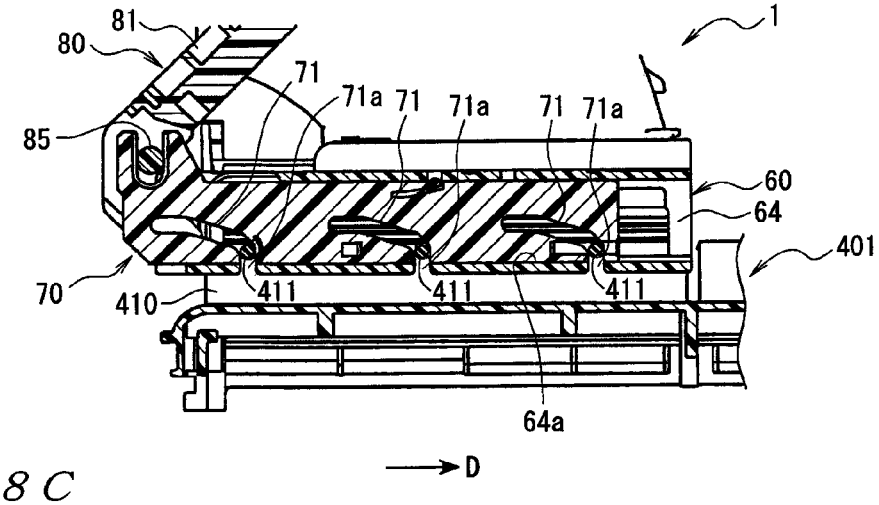
Figure 8C:
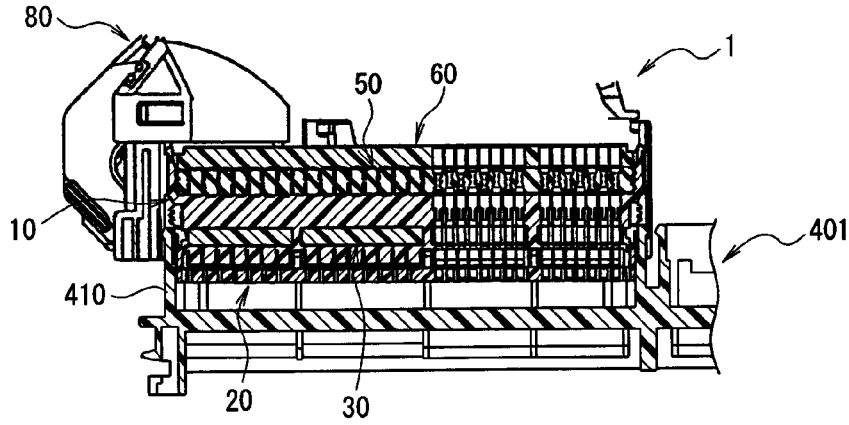

In order to mate the lever-type connector 1 and the mating connector 401, the lever 80 and the slider 70 are firstly located at separated positions illustrated in FIG. 7A to FIG. 7C. In this situation, the rotation of the lever 80 in the direction of arrow A illustrated in FIG. 8A to FIG. 8C is regulated by the first regulating projection 94 arranged at the lower side cover 91 and the upper side cover member 92. Then, in this state, the mating connector 401 is pushed in the direction of arrow C from the front side of the lever-type connector 1 as illustrated in FIG. 7A to FIG. 7C. Subsequently, the cam pins 411 arranged at the housing 410 in the mating connector 401 enter inlets 71*a* of the cam grooves 71 arranged at the sliders 70, respectively, leading to the temporary mating state where the lever-type connector 1 and the mating connector 401 are mated with each other, as illustrated in FIG. 8A to FIG. 8C.

Figure 9A:
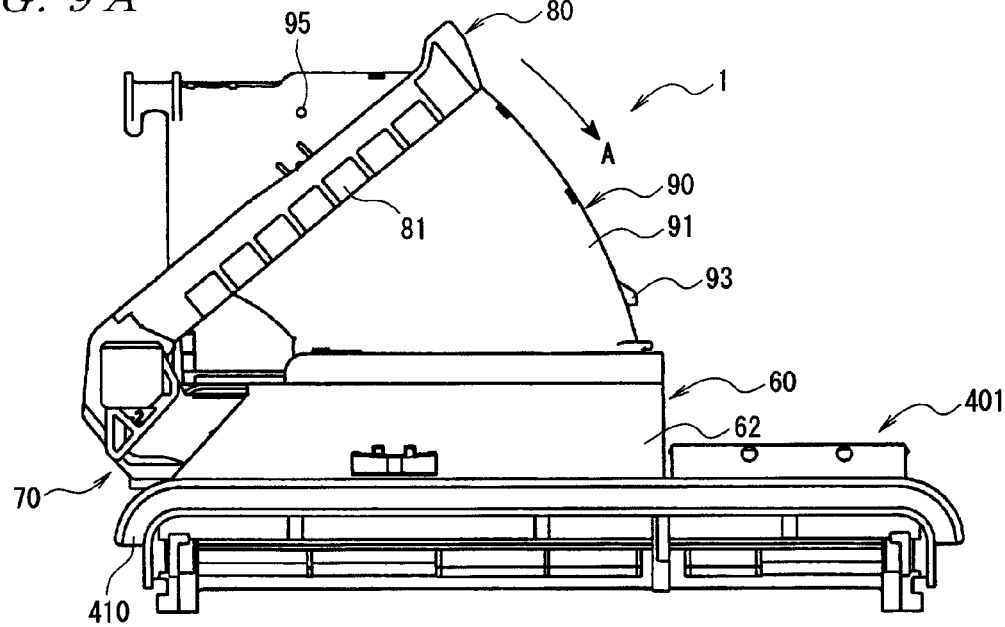
FIG. 9A to FIG. 9C are explanatory views illustrative of a state where the lever-type connector and the mating connector are on the way of being mated.
Figure 9B:
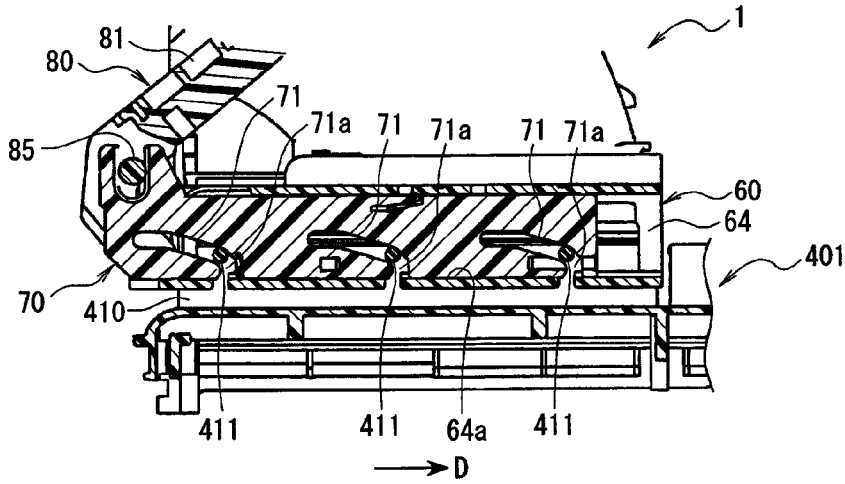
Figure 9C:
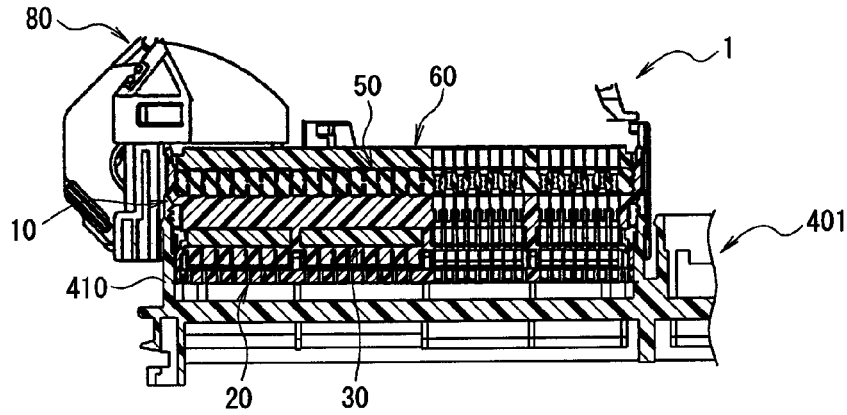

Then, when the lever 80 at the separated position is rotated in the direction of arrow A illustrated in FIG. 8A to FIG. 8C with a power greater than that necessary for releasing the regulation of the first regulating projection 94, the projection for slider movement 85 arranged at the lever 80 pushes the slider 70 in the direction of arrow D and the sliders 70 slide in conjunction with the lever 80. In this manner, the state where the lever-type connector 1 and the mating connector 401 are being mated as illustrated in FIG. 9A to FIG. 9C. In this case, the operation of the cam grooves 71 arranged at the slider 70 and the cam pins 411 arranged at the mating connector 401 causes the lever-type connector 1 and the mating connector 401 to get closer to each other slightly.

Figure 10A:
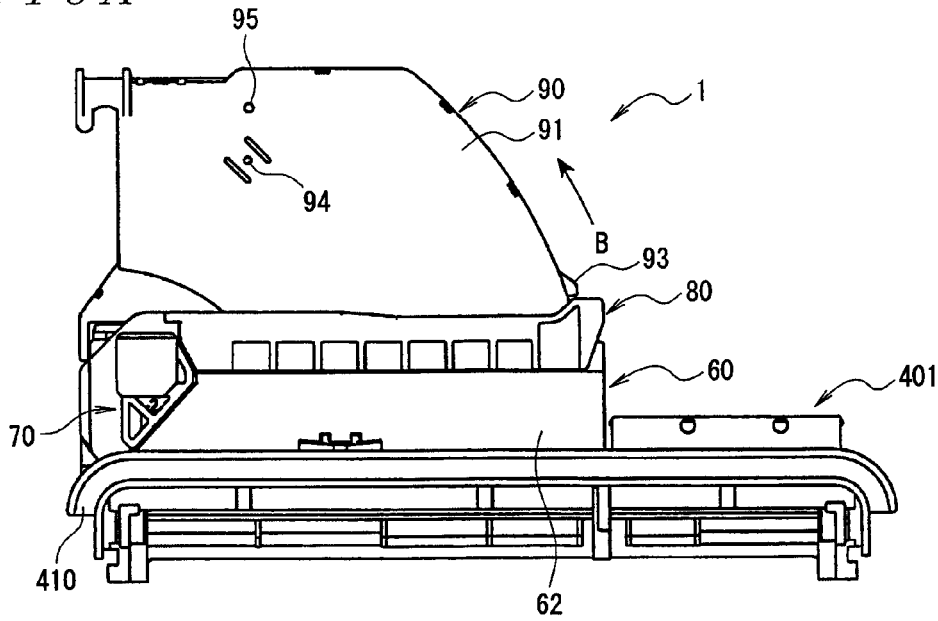
FIG. 10A to FIG. 10C are explanatory views illustrative of a state where the mating of the lever-type connector and the mating connector is completed.
Figure 10B:
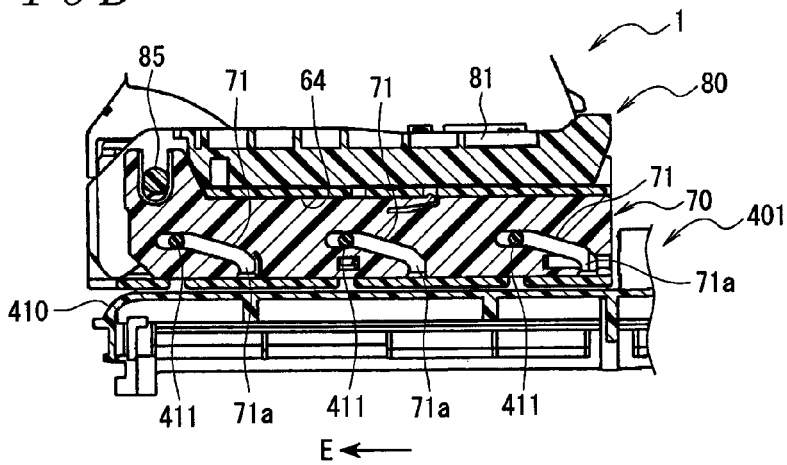
Figure 10C:
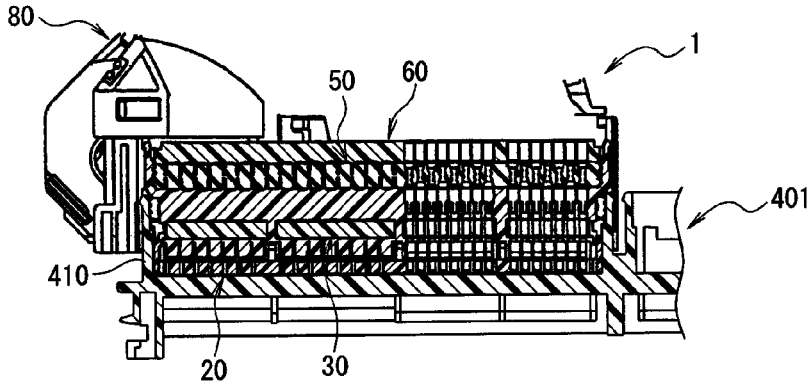
Figure 11:
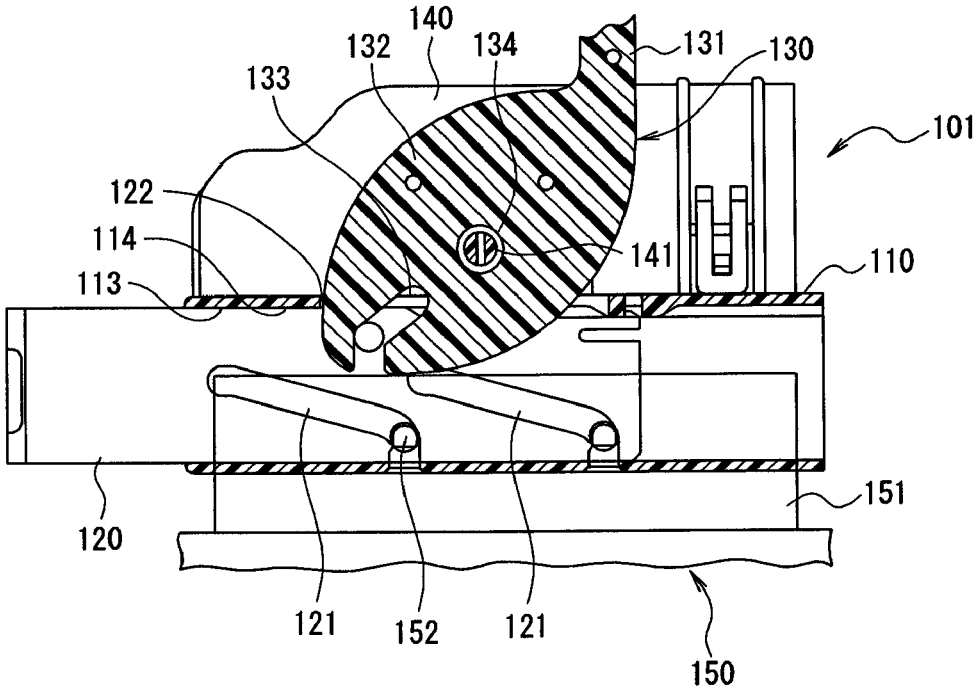
FIG. 11 is a cross-sectional view of a conventional lever-type connector.
Figure 12:
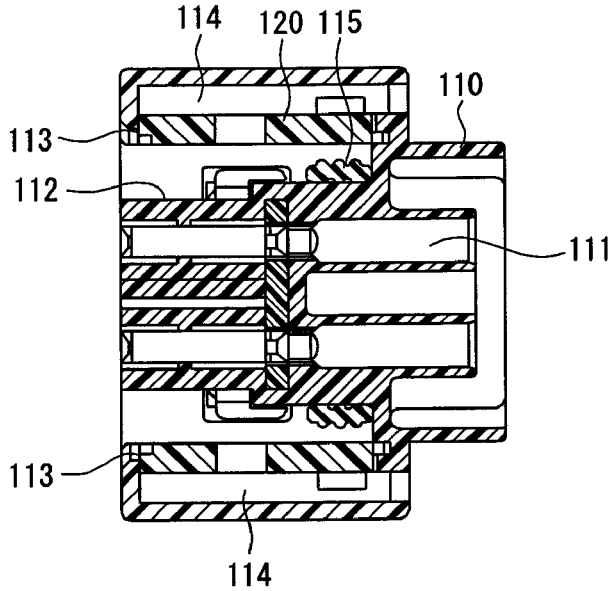
FIG. 12 is a cross-sectional view of a housing for use in the lever-type connector shown in FIG. 11.
Figure 13:
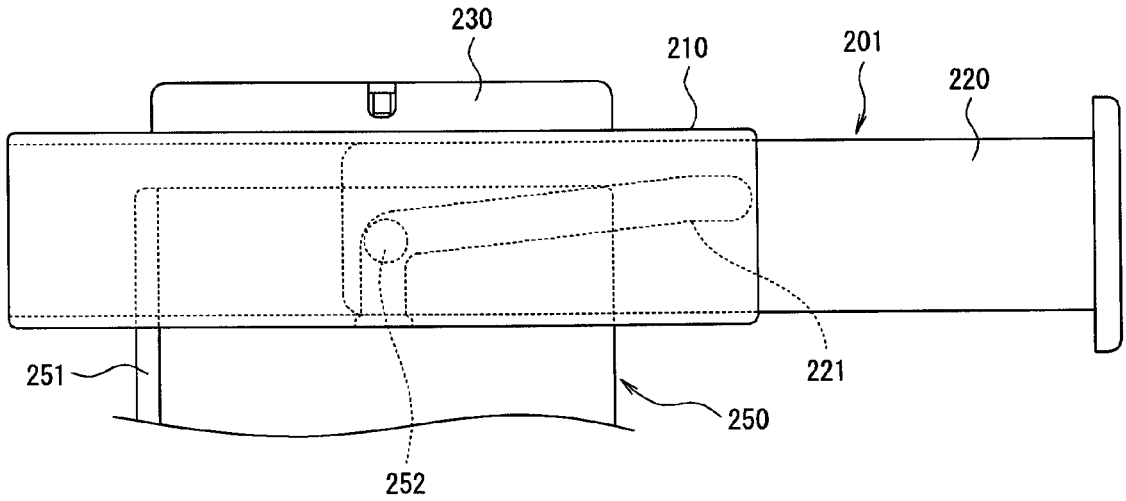
FIG. 13 is a plan view of a connector that utilizes a conventional cam-type toggle.
Figure 14:
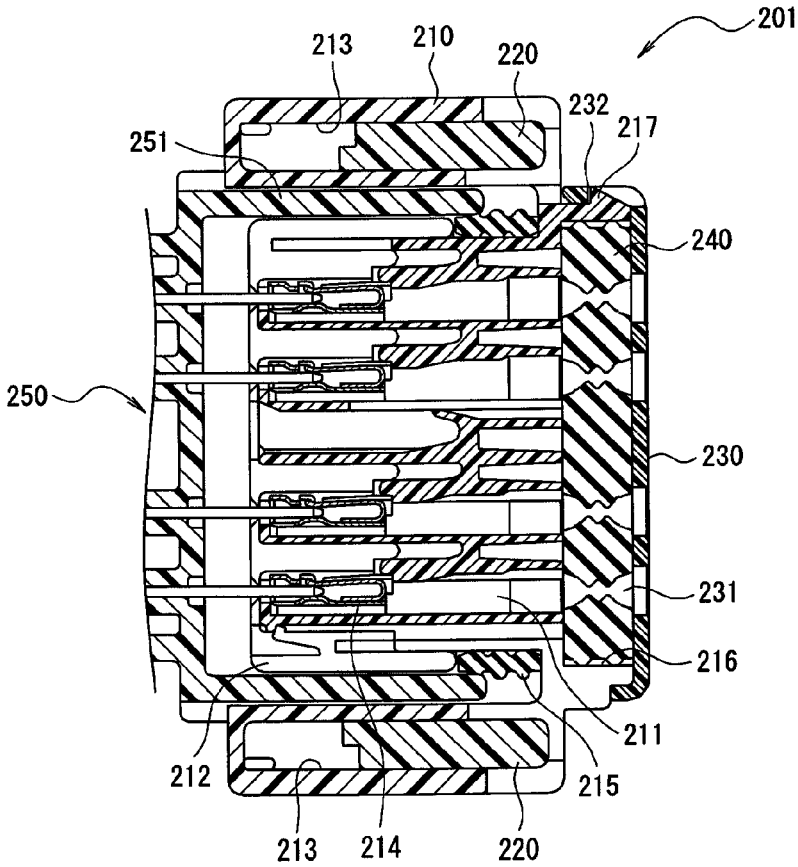
FIG. 14 is a cross-sectional view of the connector of FIG. 13.
Figure 15:
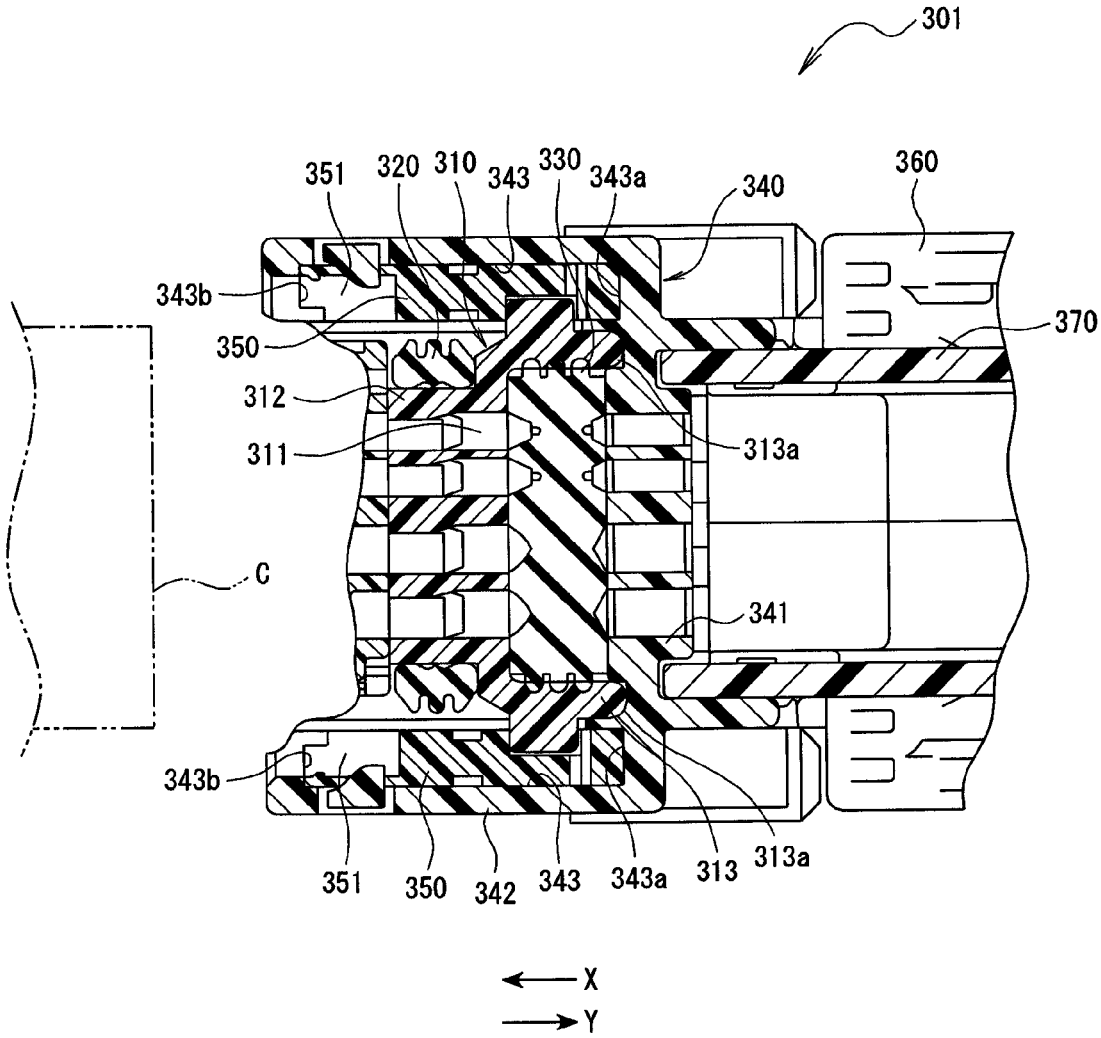
FIG. 15 schematically shows a cross-sectional view of another conventional lever-type connector.

Then, when the lever 80 is further rotated in the direction of arrow A to the mating position, the projection for slider movement 85 arranged at the lever 80 further pushes the slider 70 in the direction of arrow D, making the slider 70 slide in conjunction with the lever 80. In this manner, the mating state is completed as illustrated in FIG. 10A to FIG. 10C. In this process, the operation of the cam grooves 71 arranged at the slider 70 and the cam pins 411 arranged at the mating connector 401 causes the lever-type connector 1 and the mating connector 401 to come to the final positions. Accordingly, the mating operation of the lever-type connector 1 and the mating connector 401 is completed. When the lever 80 is located at the mating position, the rotation of the lever 80 in the direction of arrow B as illustrated in FIG. 10A to FIG. 10C is prevented by the lock 93.

In this process, when the mating operation of the lever-type connector 1 and the mating connector 401 is performed, the front end surface of the slider 70 firstly pushes a front surface 64*a* of the slider receiving slot 64 arranged at the outer housing 60 in the direction of arrow X, as illustrated in FIG. 5, that is, the direction closer to the mating connector 401. In conjunction with the pushing operation of the outer housing 60, the outer housing 60 pushes a rear end surface 12*a* of the inner housing 10 in the direction closer to the mating connector 401.

Meanwhile, in order to separate the lever-type connector 1 from the mating connector 401, the lock 93 is firstly pushed so that the lever 80 can rotate. Next, the lever 80 at the mating position is rotated in the direction of arrow B as illustrated in FIG. 10A to FIG. 10C to be located at the separated position. When the lever 80 is rotated in the direction of arrow B, the projection for slider movement 85, arranged at the lever 80, pushes the slider 70 in the direction of arrow E as illustrated in FIG. 10, making the sliders 70 slide in conjunction with the lever 80. In this manner, the lever-type connector 1 and the mating connector 401 come through the state where the lever-type connector 1 and the mating connector 401 are on the way of being mated, and reach to the temporary mating state as illustrated in FIG. 8A to FIG. 8C. In this process, the operation of the cam grooves 71 arranged at the slider 70 and the cam pins 411 arranged at the mating connector 401 causes the lever-type connector 1 and the mating connector 401 to move in a direction of being separated from each other.

Subsequently, when the mating connector 401 is pulled out in a direction opposite to the direction of arrow C as illustrated in FIG. 7A to FIG. 7C, the lever-type connector 1 and the mating connector 401 are separated from each other, as illustrated in FIG. 7A to FIG. 7C.

In this process, when the lever-type connector 1 and the mating connector 401 are separated from each other, the projection insertion groove 73 of the slider 70 pulls the inner housing 10 via the projections 19 in the direction of arrow Y as illustrated in FIG. 5, that is, the direction away from the mating connector 401. Then, in conjunction with the pulling operation of the inner housing 10, the rear end surface 12*a* of the inner housing 10 pushes the outer housing 60 in the direction away from the mating connector 401.

As described, the lever-type connector 1 is configured that the slider 70 pulls the inner housing 10 to get away from the mating connector 401, when being separated from the mating connector 401. Even if a great mating force between the inner housing 10 and the mating connector 401 is exerted, it is possible to prevent the separation of the inner housing 10 from the outer housing 60 to remain at the mating connector 401 side. The retaining force of the outer housing 60 and the inner housing 10 is not related to the separation of the lever-type connector 1 from the mating connector 401.

In addition, the lever-type connector 1 is configured such that the projection insertion groove 73 of the slider 70 pulls the inner housing 10 via the projections 19, when being separated from the mating connector 401. Accordingly, the sliders 70 are capable of pulling the inner housing 10 with a simple configuration.

Also, when the lever-type connector 1 and the mating connector 401 are mated with each other, the front end surface of the slider 70 firstly pushes the front surface 64*a* of the slider receiving slot 64 arranged at the outer housing 60 in a direction closer to the mating connector 401. In conjunction with the pushing operation of the outer housing 60, the outer housing 60 pushes the rear end surface 12*a* of the inner housing 10 in a direction closer to the mating connector 401. It is therefore possible to avoid the projection insertion groove 73 of the slider 70 from directly pushing the projections 19 of the inner housing 10 in a direction closer to the mating connector 401, when the lever-type connector 1 and the mating connector 401 are mated with each other. If the projection insertion groove 73 of the slider 70 directly pushes the projections 19 of the inner housing 10 in the direction closer to the mating connector 401, a greater mating force will be needed between the inner housing 10 and the mating connector 401 as the number of the terminals is increased. Accordingly, a great force will be exerted onto the projection insertion groove 73 of the slider 70 by the projections 19. If such a great force is exerted onto the projection insertion groove 73 by the projections 19, the projection insertion groove 73 may be broken. In contrast, when the entire of the front end surface of the slider 70 pushes the front surface 64*a* of the slider receiving slot 64 arranged at the outer housing 60 in the direction closer to the mating connector 401, not only the stress exerted onto the front surface of the slider 70 but also the stress exerted onto the projection insertion groove 73 can be made small, thereby making the projection insertion groove 73 difficult to be broken.

While the embodiments of the present invention have been illustrated in detail, it should be apparent that modifications and adaptations to those embodiments may occur.

For example, when the mating of the lever-type connector 1 and the mating connector 401 is separated from each other, the lever-type connector 1 is configured such that the projection insertion groove 73 of the slider 70 pulls the inner housing 10 via the projections 19. However, the present invention is not limited to the above configuration, as long as the slider 70 pulls the inner housing 10. A projection may be provided at the slider 70 and a projection fitting groove may be provided at the inner housing 10.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A lever-type connector comprising:

an inner housing;

a contact located in the inner housing;

an outer housing attached to the inner housing;

a projection arranged at the inner housing;

a projection insertion groove provided on an inner surface of the slider, wherein the projection is inserted into the projection insertion groove, the projection insertion groove pulling the inner housing via the projection when the connector is separated from the mating connector;

a family sealing member received in the inner housing to prevent separation of the family sealing member from the connector;

a slider receiving slot disposed in the outer housing;

a slider having a cam groove into which a cam pin of a mating connector is inserted; the slider being slidably received in the slider receiving slot; and a lever being rotatably disposed on the outer housing to slide the slider;

wherein a rotational operation of the lever draws the lever-type connector to be mated or unmated with the mating connector, and wherein the slider pulls the inner housing in a direction away from the mating connector, when the lever-type connector is separated from the mating connector.

2. The lever-type connector according to claim 1, wherein the projection insertion groove is slightly wider than the diameter of the projection.

3. The lever-type connector according to claim 1, wherein the inner housing pushes the outer housing in a direction away from the mating connector while pulling the inner housing when the connector is separated from the mating connector.

4. The lever-type connector according to claim 1, wherein the outer housing pushes the inner housing in a direction closer to the mating connector when the connector is mated with the mating connector.

5. The lever-type connector according to claim 1, wherein the slider pushes the outer housing in a direction closer to the mating connector when the connector is mated with the mating connector.

6. The lever-type connector according to claim 5, wherein the outer housing pushes the inner housing in a direction closer to the mating connector when the connector is mated with the mating connector.

7. The lever-type connector according to claim 1, further comprising a seal receiving space in the inner housing to receive the family sealing member.

8. The lever-type connector according to claim 7, wherein the family sealing member is substantially plate shaped and provided with multiple electrical wire insertion openings.

9. The lever-type connector according to claim 8, further comprising contact receiving cavities in the inner housing, the electrical wire insertion openings of the family sealing member corresponding to a position of the contact receiving cavities.

10. The lever-type connector according to claim 1, wherein the lever includes a pair of arms and a connector that connects one end of the arms.

11. The lever-type connector according to claim 10, further comprising an extension positioned at other ends of each of the arms.

12. The lever-type connector according to claim 11, wherein the extension extends at a right angle with respect to the arm.

13. The lever-type connector according to claim 11, further comprising a pivot protruding from an inner surface of each extension.

14. The lever-type connector according to claim 13, further comprising a pivot receiving portion arranged at one end in the widthwise direction of the outer housing, the pivot fitting into the pivot receiving portion.

15. The lever-type connector according to claim 11, further comprising a projection for slider movement positioned on an outer surface of the other end of each arm.

16. The lever-type connector according to claim 15, further comprising a slider depression at one end portion of an inner surface of the slider, the projection fitting into a slider depression of the slider.

17. A lever-type connector comprising:

an inner housing;

a contact located in the inner housing;

an outer housing attached to the inner housing;

a family sealing member received in the inner housing to prevent separation of the family sealing member from the connector;

a slider receiving slot disposed in the outer housing;

a slider having a cam groove into which a cam pin of a mating connector is inserted; the slider being slidably received in the slider receiving slot; and a lever being rotatably disposed on the outer housing to slide the slider, wherein the lever includes a pair of arms and a connector that connects one end of the arms;

an extension positioned at other ends of each of the arms;

a pivot protruding from an inner surface of each extension;

a pivot receiving portion arranged at one end in the widthwise direction of the outer housing, the pivot fitting into the pivot receiving portion;

wherein a rotational operation of the lever draws the lever-type connector to be mated or unmated with the mating connector, and wherein the slider pulls the inner housing in a direction away from the mating connector, when the lever-type connector is separated from the mating connector.

18. The lever-type connector according to claim 17, wherein the extension extends at a right angle with respect to the arm.

19. The lever-type connector according to claim 17, further comprising a projection for slider movement positioned on an outer surface of the other end of each arm.

20. The lever-type connector according to claim 19, further comprising a slider depression at one end portion of an inner surface of the slider, the projection fitting into a slider depression of the slider.

21. The lever-type connector according to claim 17, further comprising a seal receiving space in the inner housing to receive the family sealing member.

22. The lever-type connector according to claim 21, wherein the family sealing member is substantially plate shaped and provided with multiple electrical wire insertion openings.

23. The lever-type connector according to claim 22, further comprising contact receiving cavities in the inner housing, the electrical wire insertion openings of the family sealing member corresponding to a position of the contact receiving cavities.

* * * * *